US005451162A

United States Patent [19]

Parsons

[11] Patent Number: 5,451,162

[45] Date of Patent: Sep. 19, 1995

[54] MOCK TRAINING WEAPON AND METHOD OF TRAINING LAW ENFORCEMENT PERSONNEL USING SAME

[75] Inventor: Kevin Parsons, Appleton, Wis.

[73] Assignee: Armament Systems & Procedures, Appleton, Wis.

[21] Appl. No.: 771,193

[22] Filed: Oct. 4, 1991

[51] Int. Cl.[6] ..... F41F 27/00

[52] U.S. Cl. ..... 434/16

[58] Field of Search ..... 434/16, 11, 19; 446/473; 42/106; D21/147

[56] References Cited

U.S. PATENT DOCUMENTS 1,494,407 5/1924 Beach ..... 42/106

*Primary Examiner*—V. Millin

*Attorney, Agent, or Firm*—Robert C. Curfiss; Butler & Binion

[57] ABSTRACT

A mock weapon is cast in a non-metallic material from a master mold made directly from a standard issue side arm weapon, providing a mock weapon having the same size, shape and feel as the standard issue weapon for law enforcement training exercises. This provides law enforcement personnel with a training weapon which is safe to use, while conforming to the feel of a standard issue weapon for enhancing the training exercises in the proper and proficient handling of a specific, standard issue side arm weapon.

11 Claims, 1 Drawing Sheet

MOCK TRAINING WEAPON AND METHOD OF TRAINING LAW ENFORCEMENT PERSONNEL USING SAME

BACKGROUND OF THE INVENTION

1. Field of the Invention

The invention is generally related to a method and apparatus for training law enforcement personnel and is specifically directed to a mock weapon and a method for training personnel using the mock weapon.

2. Description of the Prior Art

One of the most important aspects of training law enforcement personnel is the proper handling and use of firearms such as holstered side arms and the like. It is particularly important that law enforcement personnel be able to maneuver and handle the weapon in a safe and efficient manner, removing the weapon from the holster, replacing the weapon in the holster, at times using the weapon as a non-firing threat and assuring that the weapon does not accidentally misfire or become unholstered during hand-to-hand combat or other maneuvers. In the past, police training programs have utilized standard issue live weapons during training exercises. More recently, standard issue weapons have been substituted with "plugged" live weapons or a variety of mock weapons in order to minimize the risk of accidental firing during training exercises.

Where standard issue weapons are used during training exercises, accidental shootings have occurred. However, use of the standard issue weapon is desirable since the trainee becomes familiar with the actual weapon to be used on duty. This is particularly important in order to develop a "feel" for the weapon, proper holstering techniques, familiarity with the weapon weight and balance and the various other aspects unique to each particular weapon. In order to increase the safety factor during the training exercise, some law enforcement training programs have incorporated the plugged or deactivated standard issue weapons for the training exercise. While this is effective in both increasing the safety of the training exercises and also in promoting the familiarity of the trainee with the standard issue weapon, such an approach is extremely costly.

More recently, training programs have incorporated the use of aluminum or other metal cast mock weapons during the training exercises. While this reduces the cost of the training program and eliminates any chance for accidental firing of the weapon, the metal mock weapons have proven undesirable because of their tendency to weigh more than standard issue weapons. Also, such mock weapons tend to have a different center of gravity from the standard issue weapon making the "feel" of the mock weapon substantially different from that of a standard issue weapon. This requires the trainee to relearn certain aspects of weapon handling once he is issued a standard issue weapon, even after completing the same training exercises with the mock weapon.

Further, the metal cast mock weapons have proven to be difficult to match in size with a standard issue weapon, often making weapon retention techniques different from the standard issue weapon due to the differing feel and fit of the weapon with the holster. In addition, such weapons tend to be relatively costly, do not have the appearance of the standard issue weapon and tend to be a poor, rough replica of the standard issue weapon. However, such mock metal cast mock weapons are in relatively common use because of the safety advantages over the use of standard issue weapons and the cost advantages over the use of deactivated standard issue weapons.

SUMMARY OF THE INVENTION

The present invention overcomes the disadvantages of both the use of standard issue weapons, whether or not deactivated, and the prior art metal cast weapons. In the preferred embodiment of the subject invention, the mock weapon is made of a non-metallic material wherein a permanent master cavity of a standard issue weapon is created using the selected weapon identified by each particular law enforcement agency. The master cavity is then used to create the non-metallic weapon in the precise shape and size of the standard issue weapon.

The mock weapon of the subject invention permits the law enforcement trainee to become familiar with the feel of the weapon, with a proper feel and fit in the holster and in the trainee's hand. Further, in many instances, it is desirable to provide the mock weapon with slightly rounded external edges to minimize injury from blunt blows during training exercises. Thus, the mock weapon of the subject invention is identical in appearance, size and feel to the standard issue weapon with the exception of utilizing rounded edges, where desired, to further increase the safety of the training exercises.

The non-metallic material utilized to make the mock weapon of the subject invention is of a lower density than the metal utilized in the standard weapon, making the mock weapon lighter than, or in the worst case, no heavier than the standard issue weapon, permitting the trainee to become familiar with the feel of the weapon, without having to relearn many aspects of the training when once issued a standard issue weapon.

Where desired, a weighted insert may be embedded in the mock weapon, for matching the weight of the mock weapon of the subject invention with the selected standard issue weapon. The weight may be placed within the mold in such a manner to provide an identical center of gravity with that of a standard issue weapon, providing a mock weapon with the same balance and feel of the standard issue weapon.

To further increase the safety aspects of the mock weapon of the subject invention, the mock weapon may be molded in a bright distinguishable color so that it cannot be confused with a standard issue weapon or, may be coated with a color of choice to properly distinguish the weapon from standard issue weapons.

It is, therefore, an object and feature of the subject invention to provide for a method of training law enforcement personnel utilizing a non-metallic mock weapon which has the same size, shape and feel as a selected standard issue weapon.

It is a further object and feature of the subject invention to provide for a mock weapon which may be cast in a master mold cavity created by a selected standard issue weapon to provide for a mock weapon having the same size and shape as a selected standard issue weapon.

It is yet another object and feature of the subject invention to provide for a weighted mock weapon having the same weight and balance as a selected standard issue weapon.

It is a further object and feature of the subject invention to provide for a mock weapon having an appearance which is clearly distinguishable from a standard issue weapon even though the mock weapon is of the same size, shape and balance as the standard issue weapon.

DETAILED DESCRIPTION OF THE PREFERRED EMBODIMENT

Figure 1:
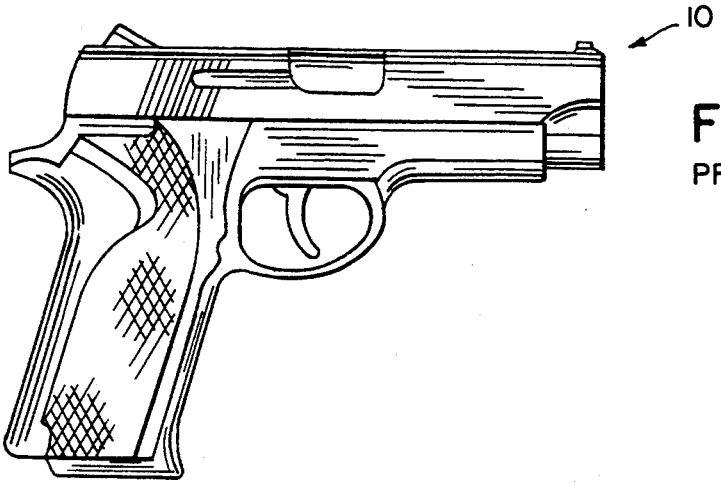
FIG. 1 PRIOR ART
FIG. 1 is an elevation view of the currently available standard issue weapon for use by law enforcement personnel and is prior art.

As shown in FIG. 1, standard issue side arm weapons, such as by way of example, the Smith & Wesson 10 mm stainless steel semi-automatic pistol designated by the numeral 10, are used by a number of police enforcement agencies as the firearm to be carried by law enforcement personnel while on duty. During the training process, the law enforcement personnel not only must learn to become proficient in the use of the weapon as a firearm but must also be well versed in the efficient and safe handling of the weapon during non-firing maneuvers such as placing the weapon in the holster, removing the weapon from the holster and various rigorous activities and exercises to which law enforcement personnel are exposed while carrying the weapon. In order to maximize the safety of such training procedures, many law enforcement agencies have replaced the standard issue weapon 10 with mock weapons during handling exercises and training programs.

Figure 2:
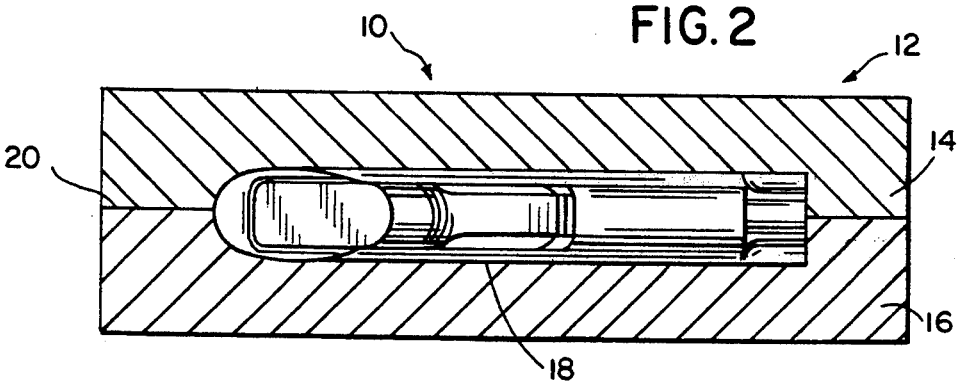
FIG. 2 is a diagrammatic illustration showing the use of the weapon of FIG. 1 to make a master mold cavity in accordance with the subject invention.

The mock weapon of the subject invention and the training program utilizing the mock weapon are unique in that the weapon is designed to have the same, shape and feel as the standard issue weapon 10. This is accomplished by using the standard issue weapon 10 as the master for a permanent mold 12, as shown in FIG. 2. As there shown, the standard issue weapon 10 is placed in a material comprising the upper half 14 and lower half 16 of a master mold 12, to produce a cavity 18 which conforms identically to the exterior shape of the standard weapon 10. After the mold is properly cured, the mold is parted along the parting line 20, and the standard issue weapon 10 is removed, leaving a mold cavity 18 which conforms identically to the standard issue weapon 10. In the preferred embodiment, the mold is constructed of an epoxy or silicon rubber material and standard well-known mold making procedures are used. It will be understood by those who are skilled in the art that any mold process can be utilized as long as the mold cavity 18 conforms substantially to the size and shape of the standard issue weapon 10.

Figure 3:
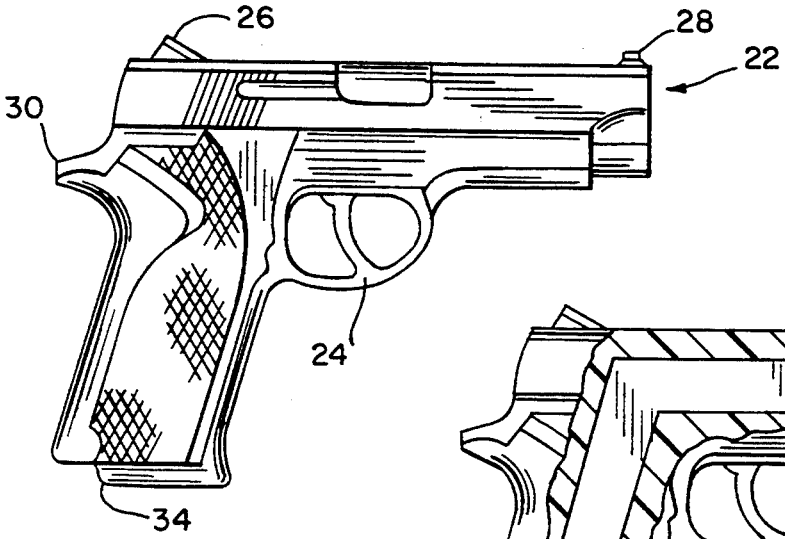
FIG. 3 is an elevation view of a mock weapon made in accordance with the teachings of the subject invention.

As shown in FIG. 3, the mold 12 is then used to make a mock weapon 22 which has the same exterior shape and size as the standard issue weapon 10. It will be noted, as shown at 24, that the trigger of the mock weapon 22 is molded into the guard. If desired, this may be trimmed, but is not deemed necessary for most training procedures. In addition, it may be desirable to round the blunt edges of the mock weapon 22, particularly as shown at 26, 28, 30 and 34. This minimizes the risk of injury by blunt blow during the training exercises. The radius on each of the sharp edges may be provided by placing filler in the mold cavity 18 or by machine finishing the mock weapon 22 after it is removed from the mold.

Figure 4:
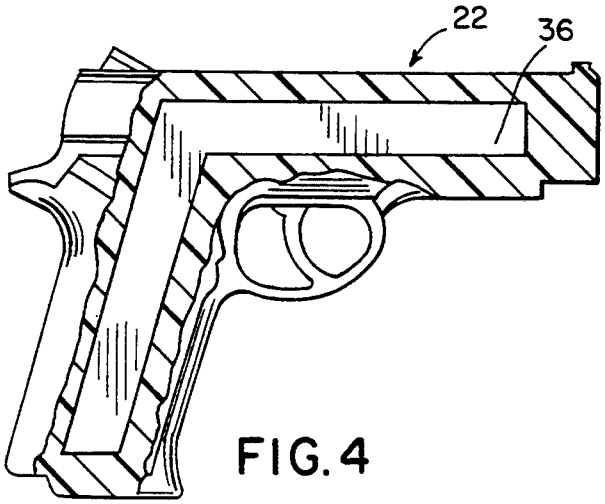
FIG. 4 is a view similar to FIG. 3, partially in section, illustrating the placement of a weighted material within the molded mock weapon of FIG. 3.

In the preferred embodiment, the mock weapon 22 is made of a cast urethane material, having a density lower than that of the density of the base material for the standard issue weapon 10, whereby the weight of the mock weapon 22 is generally lighter than and never heavier than the standard issue weapon 10.

Where desired, a weighted insert such as a heavy metal core 36 or the like may be placed within the molded mock weapon 22, as shown in FIG. 4. The size and shape of the weighted insert 36 may be constructed to provide a mock weapon 22 having the same weight as the standard issue weapon 10, further enhancing the training exercises. In addition, the insert 36 may be positioned within the molded mock weapon 22 such that the center of gravity of the mock weapon is substantially identical to the center of gravity of the standard issue weapon 10, providing a mock weapon 22 having the same balance as a standard issue weapon.

In the preferred embodiment, the base material of the mock weapon 22 is provided with a bright pigment, producing a mock weapon of a bright distinguishing color, clearly differentiating the mock weapon from a standard issue weapon. While red pigmentation is the color of choice, it will be readily understood that any differentiating color can be utilized to achieve this objective. Further, the same objective could be achieved by coating the mock weapon 22 with an exterior finish coat of any desired color.

In typical use, the specific standard issue side arm weapon of the law enforcement agency is identified, such as by way of example, the Smith & Wesson 10 mm stainless steel semi-automatic pistol weapon as illustrated in FIG. 1. Once the standard issue weapon has been designated, a permanent cavity mold is produced directly from the standard issue side weapon. The mold is then used to cast a mock weapon in a non-metallic material from the mold, the mock weapon substantially conforming in size and shape to the standard issue side arm weapon. The mock weapon may then be utilized in all training exercises for handling and manipulating the standard issue side arm weapon, thereby maximizing the ability of the law enforcement personnel in the proper and safe handling of the specific standard issue side arm weapon. Once the training exercises are complete and the law enforcement personnel have achieved the appropriate level of proficiency, the mock weapon is replaced with the standard issue side arm weapon. By using the mock weapon of the subject invention, the law enforcement trainee can become fully familiar with a weapon having the same size, shape, feel and balance as a standard issue weapon, minimizing the "relearning" curve once the standard issue weapon is issued. The subject invention provides an enhanced training method for training law enforcement personnel in the proper and proficient handling of the specific standard issue side arm weapon while providing maximum safety to personnel during the training program.

While certain features and embodiments of the invention have been described in detail herein, it will readily understood that the invention encompasses all modifications and enhancements within the scope and spirit of the following claims.

I claim:

1. A method for training law enforcement personnel in the proper manual handling and manipulation other than aiming and firing of a specific, standard issue sidearm weapon, the method comprising the steps of:

a. identifying and designating a specific standard issue sidearm weapon to be used by designated law enforcement personnel;

b. designating a standard holster specifically designed for the specific standard issue sidearm weapon;

c. making a permanent cavity mold directly from the specific standard issue sidearm weapon;

d. casting a mock weapon in a non-metallic material from the mold in the precise size and shape of the specific standard issue sidearm weapon, wherein said mock weapon is adapted to be carried in said holster in precisely the same manner as the specific standard issue weapon;

e. utilizing the mock weapon in training exercises for maximizing the ability of the law enforcement personnel in the safe manual handling and manipulation other than aiming and firing of the specific, standard issue sidearm weapon; and f. replacing the mock weapon with such standard issue sidearm weapon after a predetermined level of skill in the manual handling of the mock weapon has been achieved.

2. The method of claim 1, wherein said mock weapon is made of a cast urethane material.

3. The method of claim 1, wherein said mock weapon includes an outer shell of a bright color clearly distinguishing it from said standard issue side arm weapon.

4. The method of claim 1, wherein said mock weapon is lighter in weight than said standard issue side arm weapon.

5. The method of claim 1, including the step of rounding all of the exposed edges on the mock weapon for minimizing injury to personnel during training exercises.

6. The method of claim 5, wherein said mock weapon is made of a cast urethane material.

7. The method of claim 5, including the step of inserting a weight in the mold cavity before forming the mock weapon for producing a weighted mock weapon having substantially the same weight as the standard issue firearm.

8. The method of claim 7, wherein said weight is placed in said mold such that the center of gravity of the mock weapon and the center of gravity of the standard issue firearm are substantially identical.

9. The method of claim 1, wherein a predetermined force must be applied to said standard issue side arm weapon to withdraw the weapon from said holster, and wherein said mock weapon is designed to require substantially the same predetermined force to withdraw the mock weapon from said holster.

10. The method of claim 1, including the step of inserting a weight in the mold cavity before forming the mock weapon for producing a weighted mock weapon having substantially the same weight as the standard issue side arm weapon.

11. The method of claim 1, wherein the mock weapon is made of a material which is clearly distinguishable from the appearance of the standard issue side arm weapon.

* * * * *